US008974018B2

(12) United States Patent
Iwata

(10) Patent No.: US 8,974,018 B2
(45) **Date of Patent: *Mar. 10, 2015**

(54) LIQUID DISCHARGE APPARATUS AND LIQUID CIRCULATION METHOD

(71) Applicant: Seiko Epson Corporation, Tokyo (JP)

(72) Inventor: Yuji Iwata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/662,701

(22) Filed: Oct. 29, 2012

(65) Prior Publication Data

US 2013/0113852 A1 May 9, 2013

(30) Foreign Application Priority Data

Nov. 7, 2011 (JP) ..... 2011-243728

(51) Int. Cl.

| | |
|---|---|
| ***B41J 29/393*** | (2006.01) |
| ***B41J 2/175*** | (2006.01) |
| ***B41J 29/377*** | (2006.01) |
| ***B41J 29/38*** | (2006.01) |
| *B41J 11/00* | (2006.01) |

(52) U.S. Cl.

CPC ..... *B41J 2/175* (2013.01); *B41J 2/17509* (2013.01); *B41J 29/377* (2013.01); *B41J 29/38* (2013.01); *B41J 11/002* (2013.01)

USPC ..... 347/6

(58) Field of Classification Search

CPC ..... B41J 2/125; B41J 2/175; B41J 2/17509; B41J 2/17513; B41J 2/1752; B41J 2/17553; B41J 2/17596; B41J 2/18; B41J 2202/20

USPC ..... 347/6, 9, 14, 19, 84–86, 95, 96

See application file for complete search history.

(56) References Cited

U.S. PATENT DOCUMENTS

| | | | | |
|---|---|---|---|---|
| 4,607,261 | A | 8/1986 | McCann et al. | |
| 4,680,696 | A | 7/1987 | Ebinuma et al. | |
| 6,000,792 | A | 12/1999 | Koizumi et al. | |
| 6,039,442 | A | 3/2000 | Hagiwara et al. | |
| 2007/0291086 | A1 * | 12/2007 | Murakami et al. | 347/85 |

(Continued)

FOREIGN PATENT DOCUMENTS

| | | |
|---|---|---|
| EP | 2305475 | 4/2011 |
| GB | 2447919 | 10/2008 |

(Continued)

*Primary Examiner* — Manish S Shah
*Assistant Examiner* — Roger W Pisha, II
(74) *Attorney, Agent, or Firm* — Workman Nydegger

(57) ABSTRACT

Disclosed herein is a liquid discharge apparatus including a transporting unit to transport a medium, a storage unit to store liquid, a head unit to discharge the liquid onto the medium, a plurality of supply flow paths to supply the liquid from the storage unit to the head unit, a plurality of bypass flow paths, and a controller that causes alternately to repeat a transport operation which transports the medium by the transporting unit and a liquid discharge operation which discharges the liquid from the head unit, thereby to form an image on the medium, and to circulate, when the liquid is not discharged during execution of the image forming process, the liquid within a circulation flow path constituted only by the supply flow paths and the bypass flow paths among the storage unit, the head unit, the supply flow paths, and the bypass flow paths.

5 Claims, 10 Drawing Sheets

(56) References Cited

U.S. PATENT DOCUMENTS

| | | | | |
|---|---|---|---|---|
| 2009/0009541 | A1 | 1/2009 | Shimazaki | |
| 2009/0167826 | A1 | 7/2009 | Ishizawa et al. | |
| 2009/0201347 | A1* | 8/2009 | Hamano | 347/85 |
| 2009/0231368 | A1 | 9/2009 | Nakano et al. | |
| 2009/0303283 | A1 | 12/2009 | Nakano et al. | |
| 2009/0315927 | A1* | 12/2009 | Uehara | 347/7 |
| 2010/0079511 | A1 | 4/2010 | Murakami et al. | |
| 2010/0085396 | A1 | 4/2010 | Yokota et al. | |
| 2010/0283808 | A1 | 11/2010 | Terakado et al. | |
| 2011/0115844 | A1* | 5/2011 | Ozawa | 347/28 |
| 2011/0267406 | A1 | 11/2011 | Hanson | |

FOREIGN PATENT DOCUMENTS

| | | |
|---|---|---|
| JP | 60-137655 | 7/1985 |
| JP | 6079876 | 3/1994 |
| JP | 2011-110853 | 6/2011 |

* cited by examiner

LIQUID DISCHARGE APPARATUS AND LIQUID CIRCULATION METHOD

CROSS REFERENCES TO RELATED APPLICATIONS

This application claims the benefit of Japanese Patent Application No. 2011-243728, filed on Nov. 7, 2011, which is hereby incorporated by reference herein in its entirety.

BACKGROUND

1. Technical Field

The present invention relates to a liquid discharge apparatus and a liquid circulation method.

2. Related Art

A liquid discharge apparatus has been well known which includes a transporting unit to transport a medium, a storage unit to store liquid, a head unit to discharge the liquid onto the medium, and a plurality of supply flow paths to supply the liquid from the storage unit to the head unit. As such a liquid discharge apparatus, there may be exemplified an ink jet printer which discharges ink onto various media such as paper and films and carries out printing thereon.

However, there is a problem in that the liquid stays within the above-mentioned supply flow paths to supply the liquid from the storage unit to the head unit, thereby causing an issue in which a component of the liquid is settled. Accordingly, such a phenomenon results in deterioration in the quality of an image (see Japanese Patent No. 3106013).

SUMMARY

An advantage of some aspects of the invention is to appropriately suppress deterioration in the quality of an image.

According to an aspect of the invention, a liquid discharge apparatus includes a transporting unit to transport a medium; a storage unit to store liquid; a head unit to discharge the liquid onto the medium; a plurality of supply flow paths to supply the liquid from the storage unit to the head unit; a plurality of bypass flow paths laid between the supply flow paths which are different from one another; and a controller that causes alternately to repeat a transport operation which controls the transporting unit and transports the medium and a liquid discharge operation which discharges the liquid from the head unit, thereby to execute an image forming process to form an image on the medium, and to circulate, when the liquid is not discharged during execution of the image forming process, the liquid within a circulation flow path constituted only by the supply flow paths and the bypass flow paths among the storage unit, the head unit, the supply flow paths, and the bypass flow paths.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
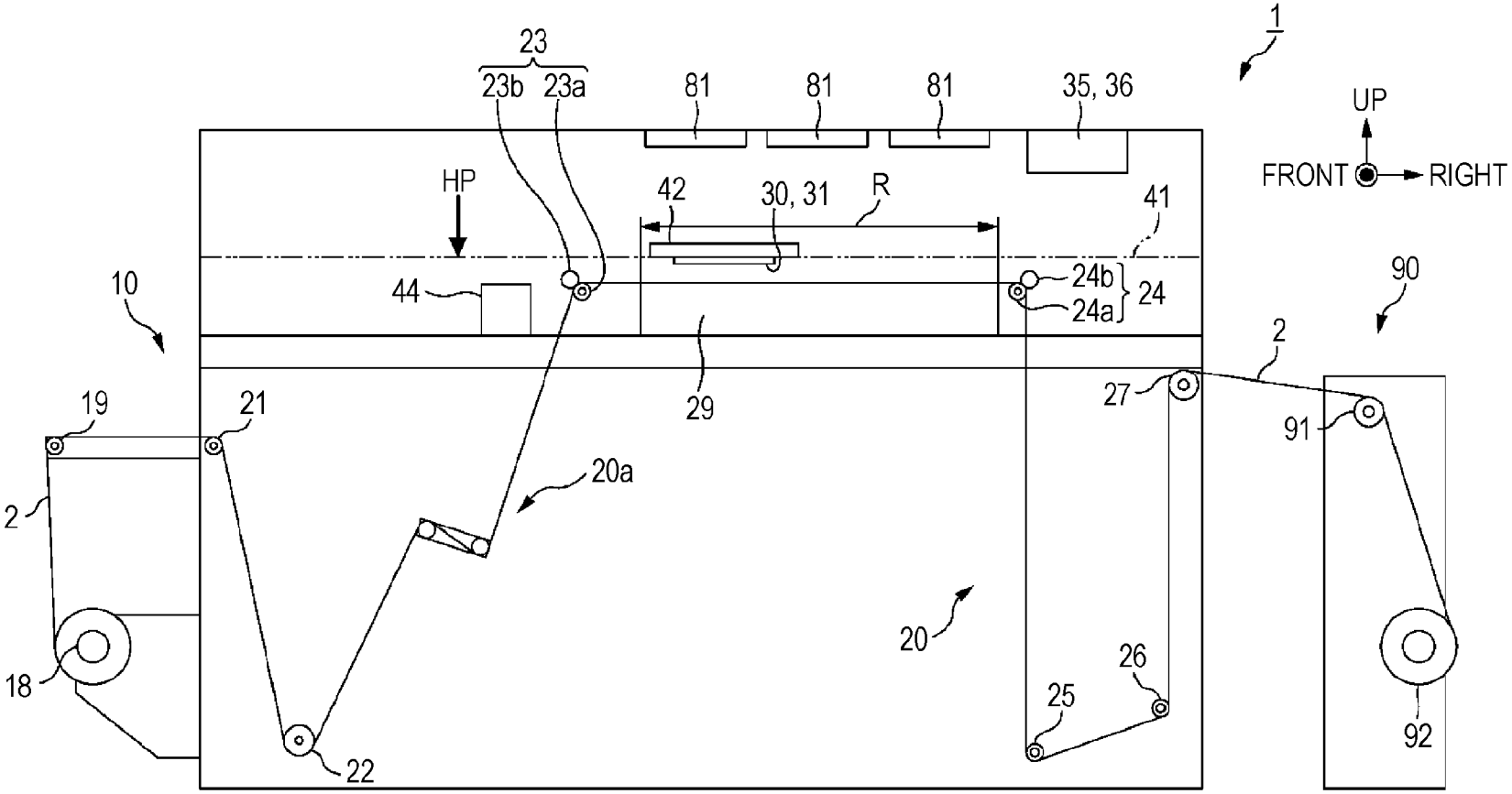
FIG. 1 is a view schematically illustrating a configuration of an image recording apparatus.

The following configurations will become apparent from embodiments to be described later and with reference to the accompanying drawings.

A liquid discharge apparatus includes a transporting unit to transport a medium; a storage unit to store liquid; a head unit to discharge the liquid onto the medium; a plurality of supply flow paths to supply the liquid from the storage unit to the head unit; a plurality of bypass flow paths laid between the supply flow paths which are different from one another; and a controller that causes alternately to repeat a transport operation which controls the transporting unit and transports the medium and a liquid discharge operation which discharges the liquid from the head unit, thereby to execute an image forming process to form an image on the medium, and to circulate, when the liquid is not discharged during execution of the image forming process, the liquid within a circulation flow path constituted only by the supply flow paths and the bypass flow paths among the storage unit, the head unit, the supply flow paths, and the bypass flow paths.

According to such a liquid discharge apparatus, deterioration in the quality of the image may be appropriately suppressed.

The controller may cause to circulate the liquid within the circulation flow path when the transport operation is performed.

In such a case, since the liquid is circulated effectively using a time at which the transport operation is performed, an effective process may be realized.

The head unit may include a plurality of sub-head units. Each of the plurality of supply flow paths may supply the liquid to the sub-head unit corresponding to each supply flow path. The controller may determine whether or not the liquid discharge operation exists in which a part of the plurality of sub-head units does not discharge the liquid, and determine whether or not to circulate the liquid within the circulation flow path based on the determined result.

In such a case, since the liquid circulation process is executed only if necessary, an effective process may be realized.

The liquid discharge apparatus may further include a platen to support and heat the medium. The head unit may discharge the liquid onto the medium which is supported and heated by the platen.

In such a case, an effect to appropriately suppress deterioration in the quality of the image may be achieved more effectively.

Next, a liquid circulation method includes alternately repeating a transport operation which controls a transporting unit to transport a medium and transports the medium and a liquid discharge operation which discharges liquid from a head unit to discharge the liquid onto the medium, thereby executing an image forming process to form an image on the medium; and circulating, when the liquid is not discharged during execution of the image forming process, the liquid within a circulation flow path constituted only by the supply flow paths and the bypass flow paths among a storage unit to store the liquid, the head unit, a plurality of supply flow paths to supply the liquid from the storage unit to the head unit, and a plurality of bypass flow paths laid between the supply flow paths which are different from one another.

According to such a liquid circulation method, deterioration in the quality of the image may be appropriately suppressed.

Configuration Example of Image Recording Apparatus 1

Figure 2:
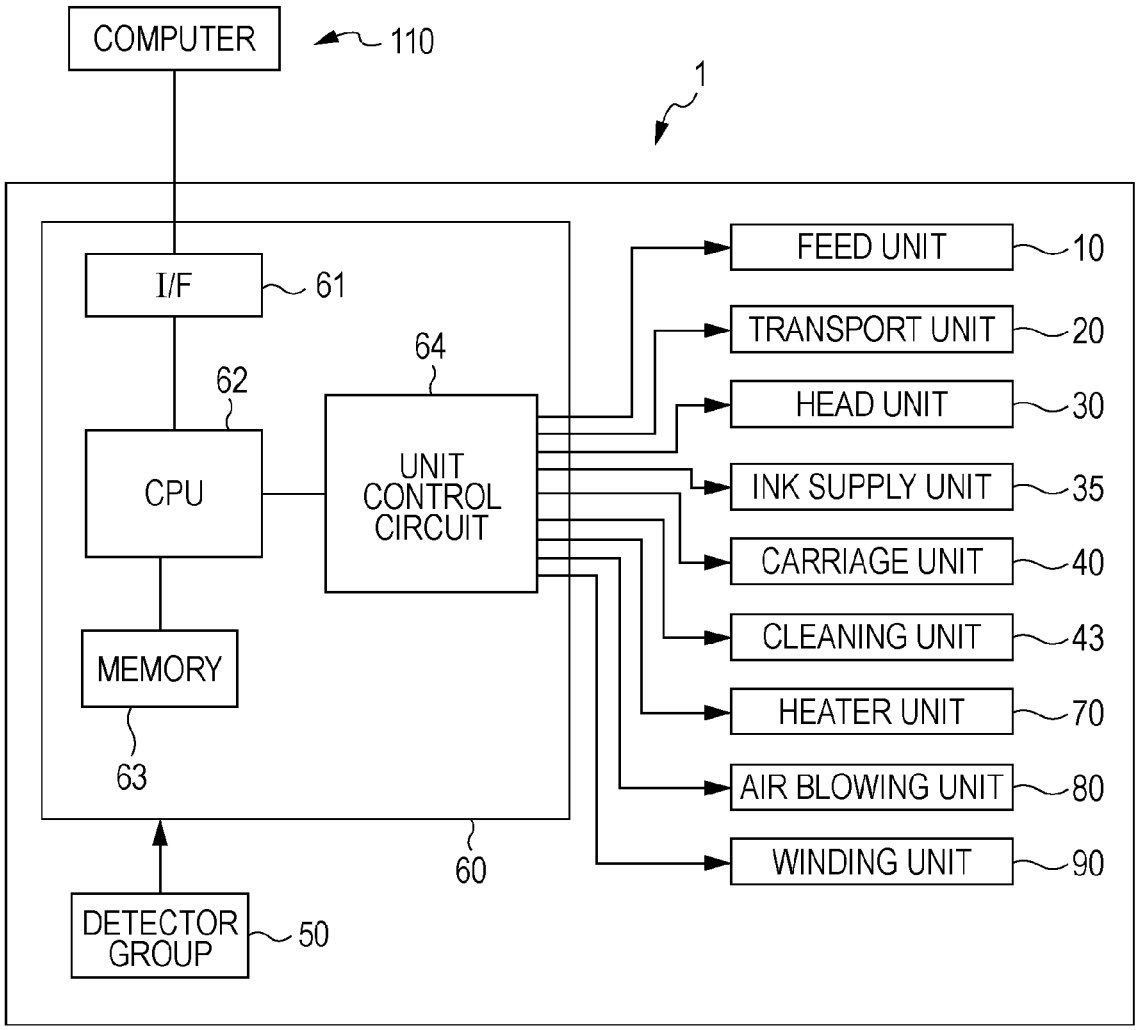
FIG. 2 is a block diagram illustrating the configuration of the image recording apparatus.

A configuration example of an image recording apparatus 1 (which is an ink jet printer in the present embodiment) as an illustration of a liquid discharge apparatus will be described with reference to FIGS. 1 and 2. FIG. 1 is a cross-sectional view schematically illustrating the image recording apparatus 1. FIG. 2 is a block diagram of the image recording apparatus 1.

In the following description, "upward and downward direction" and "left and right direction" refer to the directions indicated by the arrows in FIG. 1, respectively. Also, "front and rear direction" refers to the direction perpendicular to the paper in FIG. 1.

In addition, the embodiment will be described using paper wound into a roll (hereinafter, referred to as roll paper (continuous paper)) as an example of a medium on which the image recording apparatus 1 records an image.

As shown in FIGS. 1 and 2, the image recording apparatus 1 according to the embodiment includes a transport unit 20 as an example of a transporting unit, and a feed unit 10, a platen 29, and a winding unit 90 which are provided along a transport path on which the transport unit 20 transports the roll paper 2 (in FIG. 1, the transport path represents a section between a reel shaft 18 and a winding drive shaft 92 in which the roll paper 2 is located). Furthermore, the image recording apparatus 1 includes a head unit 30 which discharges an ink as an example of a plurality of kinds of liquid and performs the recording of the image in an image recording region R on the transport path, an ink supply unit 35, a carriage unit 40, a cleaning unit 43, a heater unit 70, an air blowing unit 80 to blow air onto the roll paper 2 on the platen 29, a controller 60 to manage an operation of the image recording apparatus 1 by the control of these units, and a detector group 50.

The feed unit 10 serves to feed the roll paper 2 into the transport unit 20. This feed unit 10 includes the reel shaft 18 around which the roll paper 2 is wound and which is rotatably supported, and a relay roller 19 around which the roll paper 2 unwound from the reel shaft 18 is wound so as to be guided to the transport unit 20.

The transport unit 20 serves to transport the roll paper 2 fed by the feed unit 10 along the transport path which is set in advance. The transport unit 20, as shown in FIG. 1, includes a relay roller 21 which is located in a horizontal right direction with respect to the relay roller 19, a relay roller 22 which is located in a right obliquely downward direction when viewed from the relay roller 21, a first transport roller 23 which is located in a right obliquely upward direction when viewed from the relay roller (at the upstream side of a transport direction when viewed from the platen 29), a steering unit 20*a* which is located between the relay roller 22 and the first transport roller 23, a second transport roller 24 which is located rightwards when viewed from the first transport roller 23 (at the downstream side of the transport direction when viewed from the platen 29), a reversal roller 25 which is located in a vertical downward direction when viewed from the second transport roller 24, a relay roller 26 which is located rightwards when viewed from the reversal roller 25, and a delivery roller 27 which is located upwards when viewed from the relay roller 26.

The relay roller 21 is a roller around which the roll paper 2 fed from the relay roller 19 is wound from the left side to be released downwards.

The relay roller 22 is a roller around which the roll paper 2 fed from the relay roller 21 is wound from the left side to be transported in the right obliquely upward direction.

The first transport roller 23 includes a first drive roller 23*a* which is driven by a motor (not shown), and a first driven roller 23*b* disposed to face the first drive roller 23*a* with the roll paper 2 being interposed therebetween. The first transport roller 23 is a roller which upwardly lifts the roll paper 2 released downwards to transport it to the image recording region R facing the platen 29. The first transport roller 23 temporally stops the transport of the roll paper while image printing is carried out with respect to a part of the roll paper 2 on the image recording region R. In addition, the first driven roller 23*b* is rotated together with the rotation drive of the first drive roller 23*a* according to the drive control of the controller 60, thereby allowing a transport amount of the roll paper 2 located on the platen 29 to be adjusted.

As described above, the transport unit 20 includes a mechanism which releases the part of the roll paper 2 wound between the relay rollers 21 and 22 and the first transport roller 23 in the downward direction to transport the released part of the roll paper 2. The release of the roll paper 2 is monitored based on a detection signal from a release detecting sensor (not shown) by the controller 60. In detail, in a case where the release detecting sensor detects a part of the roll paper 2 released between the relay rollers 21 and 22 and the first transport roller 23, since the part is given tension of an appropriate size, the transport unit 20 may transport the roll paper 2 in a released state. Meanwhile, in a case where the release detecting sensor does not detect a released part of the roll paper 2, since the part is given tension of an excessive size, the transport of the roll paper 2 by the transport unit 20 is temporally stopped so that the tension is adjusted to an appropriate size.

As shown in FIG. 1, the steering unit 20*a* is located on the transport path in an inclined state and is rotated, thereby allowing a width direction position of the roll paper 2 (position at which the roll paper 2 is located in the width direction (the front and rear direction indicated in FIG. 1)) to be changed. That is, when the roll paper 2 is transported along the transport path, the width direction position of the roll paper 2 may be displaced due to, for example, variations in tension acting on the roll paper 2 by axial deviations or assembly faults of the relay rollers, etc. Accordingly, the steering unit 20*a* serves to adjust the width direction position of the roll paper 2.

The second transport roller 24 includes a second drive roller 24*a* which is driven by a motor (not shown), and a second driven roller 24*b* disposed to face the second drive roller 24*a* with the roll paper 2 being interposed therebetween. The second transport roller 24 is a roller by which the part of the roll paper 2 after recording the image using the head unit 30 is transported along a support surface of the platen 29 in the horizontal right direction and is then transported in the vertical downward direction. Consequently, the transport direction of the roll paper 2 is changed. In addition, the second driven roller 24*b* is rotated together with the rotation drive of the second drive roller 24*a* according to the drive control of the controller 60, thereby allowing predetermined tension given to the part of the roll paper 2 located on the platen 29 to be adjusted.

The reversal roller 25 is a roller around which the roll paper 2 fed from the second transport roller 24 is wound from the left upward direction to be transported in the right obliquely upward direction.

The relay roller 26 is a roller around which the roll paper 2 fed from the reversal roller 25 is wound from the left downward direction to be transported upwards.

The delivery roller 27 is a roller around which the roll paper 2 fed from the relay roller 26 is wound from the left downward direction to be delivered to the winding unit 90.

As such, the roll paper 2 is moved sequentially via each roller, thereby forming the transport path to transport the roll paper 2. Moreover, the roll paper 2 is intermittently transported along the transport path in units of a region unit corresponding to the image recording region R by the transport unit 20.

The head unit 30 serves to record the image on the part of the roll paper 2 located at the image recording region R on the transport path. That is, the head unit 30 discharges the ink onto the part of the roll paper 2 fed to the image recording region R (namely, onto the platen 29) on the transport path by the transport unit 20 and performs the formation of the image. In the embodiment, this head unit 30 includes fifteen heads 31.

Each of the heads 31 has, on a lower surface thereof, a nozzle row in which nozzles are arranged in parallel with one another in a row direction. In the embodiment, the heads 31 respectively have the nozzle rows of which each is constituted of a plurality of nozzles #1 to #N for each ink kind (color) such as yellow (Y), magenta (M), cyan (C), black (K), and white (W). The nozzles #1 to #N of each nozzle row are linearly arranged in a direction intersecting the transport direction of the roll paper 2 (namely, the intersection direction refers to the above-mentioned row direction). The nozzle rows are arranged in parallel along the transport direction to be spaced apart from one another.

Each of the nozzles #1 to #N is provided with a piezoelectric element (not shown) as a drive element to discharge ink droplets. When a voltage having a predetermined time width is applied between electrodes provided at both ends of the piezoelectric element, the piezoelectric element is stretched in response to the applied time of the voltage and deforms a side wall of an ink passage. Hence, a volume of the ink passage is contracted in response to flexibility of the piezoelectric element, with the consequence that the ink corresponding to the contracted volume becomes ink droplets and is discharged from each of the nozzles #1 to #N associated with each color.

The head unit 30 is formed so that such fifteen heads 31 are arranged in parallel with one another in the intersection direction (the row direction). Therefore, the head unit 30 includes 15×N nozzles for each ink kind (color).

The ink supply unit 35 serves to supply, when an ink amount in the head unit 30 is decreased due to the discharge of the ink by the heads 31, ink to the head unit 30. The ink supply unit 35 will be further described in detail below.

The carriage unit 40 serves to move the head unit (heads 31). The carriage unit 40 includes a carriage guide rail 41 (which is indicated by the alternate long and two short dashes line in FIG. 1) extending in the transport direction (left and right direction), a carriage 42 which is supported to be reciprocatable along the carriage guide rail 41 in the transport direction (left and right direction), and a motor which is not shown.

The carriage 42 is provided with the head unit 30, namely, the fifteen heads 31. In more detail, the carriage 42 is divided into four sub-carriages (first sub-carriage to fourth sub-carriage). Each of the first to third sub-carriages is provided with four heads 31 and the fourth sub-carriage is provided with three heads 31.

In other words, the fifteen heads 31 are constituted of four head groups (corresponding to a plurality of sub-head units), namely, a first head group 302 to which first head to fourth head belong, a second head group 304 to which fifth head to eighth head belong, a third head group 306 to which ninth head to twelfth head belong, and a fourth head group 308 to which thirteenth head to fifteenth head belong. The first head group 302, the second head group 304, the third head group 306, and the fourth head group 308 are provided at the first sub-carriage, the second sub-carriage, the third sub-carriage, and the fourth sub-carriage, respectively.

The carriage 42 constituted of the four sub-carriages is integrally formed with the head unit 30 constituted of the four head groups (in other words, fifteen heads 31) to be moved in the transport direction (left and right direction) by the drive of the motor which is not shown.

The cleaning unit 43 (not shown in FIG. 1) serves to clean the heads 31. This cleaning unit 43 is provided at a home position (hereinafter, referred to as HP, and see FIG. 1), and includes caps (not shown), suction pumps 43*a* (see FIG. 4 and the like), etc. When the heads 31 (carriage 42) are moved in the transport direction (left and right direction) and are located at the HP, the caps (not shown) are closely attached to the respective lower surfaces (nozzle surfaces) of the heads 31. When the suction pumps 43*a* are operated in a state where the caps are closely attached to the lower surfaces of the heads 31, the ink within the heads 31 is absorbed together with thickened ink or paper dust. Consequently, the clogged nozzles are restored from a non-dischargeable state and the cleaning of the heads is completed.

In addition, a flushing unit 44 is provided between the HP and the platen 29 in the transport direction (left and right direction). When the heads 31 (carriage 42) are moved in the transport direction (left and right direction) and are located at a position facing the flushing unit 44, the heads 31 carry out a flushing operation which discharges the ink from each of the nozzles belonging to the nozzle row and performs flushing.

The platen 29 serves to support (the part of) the roll paper 2 located at the image recording region R on the transport path and heat (the part of) the roll paper 2 (that is, the head unit 30 discharges the ink onto the roll paper 2 which is supported and heated by the platen 29). As shown in FIG. 1, the platen 29 is provided corresponding to the image recording region R on the transport path, and is also disposed at an area along the transport path between the first transport roller 23 and the second transport roller 24. The platen 29 is supplied with heat generated by the heater unit 70 to enable the part of the roll paper 2 to be heated.

The heater unit 70 is to heat the roll paper 2 and includes a heater which is not shown. The heater has a nichrome wire, and the nichrome wire is disposed to be a fixed distance from the support surface of the platen 29 within the platen 29. For this reason, the nichrome wire itself of the heater generates heat by applying an electric current, such that the platen 29 may conduct the heat to the part of the roll paper 2 located on the support surface of the platen 29. Since this heater is constituted to have the nichrome wire throughout an area of the platen 29, the heater may uniformly conduct the heat with respect to the part of the roll paper 2. In the embodiment, the part of the roll paper 2 is uniformly heated so that the part of the roll paper 2 on the platen 29 has a temperature of 45° C. As a result, the ink which is impacted on the part of the roll paper 2 may be dried.

The air blowing unit 80 serves to blow air onto the roll paper 2 on the platen 29. This air blowing unit 80 includes a motor (not shown) to rotate a fan 81 and other fans 81. The fans 81 are to dry the ink which is impacted on the roll paper 2 by blowing air onto the roll paper 2 on the platen 29 by rotation of the fans 81. As shown in FIG. 1, the plurality of fans 81 are arranged at an openable and closable cover (not shown) which is provided at a main body portion. When the cover is closed, each fan 81 is disposed upward of the platen 29 and faces the support surface of the platen 29 (the roll paper 2 of the platen 29).

The winding unit 90 serves for winding the roll paper 2 (roll paper on which the image recording is completed) fed by the transport unit 20. This winding unit 90 includes a relay roller 91 around which the roll paper 2 fed from the delivery roller 27 is wound from the left upward side to be transported in the right obliquely downward direction, and a winding drive shaft 92 for winding the roll paper 2 fed from the relay roller 91 which is rotatably supported.

The controller 60 is a control unit to control the image recording apparatus 1. This controller 60 includes an interface portion 61, a CPU 62, a memory 63, and an unit control circuit 64, as shown in FIG. 2. The interface portion 61 serves to transmit and receive data between a host computer 110, which is an external device, and the image recording apparatus 1. The CPU 62 is an execution processing unit to control the entirety of the image recording apparatus 1. The memory 63 is to secure an area to store programs of the CPU 62, a work area, or the like. The CPU 62 controls each unit by the unit control circuit 64 according to the programs stored in the memory 63.

The detector group 50 serves to monitor a situation within the image recording apparatus 1. The detector group 50, for example, includes the above-mentioned release detecting sensor, a rotary encoder which is mounted to the transport roller and is used to control the transport of the roll paper 2 and the like, a paper detecting sensor to detect whether or not the roll paper 2 is transported, a linear encoder to detect a position of the carriage 42 (or heads 31) in the transport direction (left and right direction) thereof, a paper end position detecting sensor to detect a paper end (edge) position of the roll paper 2 in the width direction thereof, and a sub-tank sensor to be described later.

Ink Supply Unit 35

Configuration Example of Ink Supply Unit 35

Figure 3:
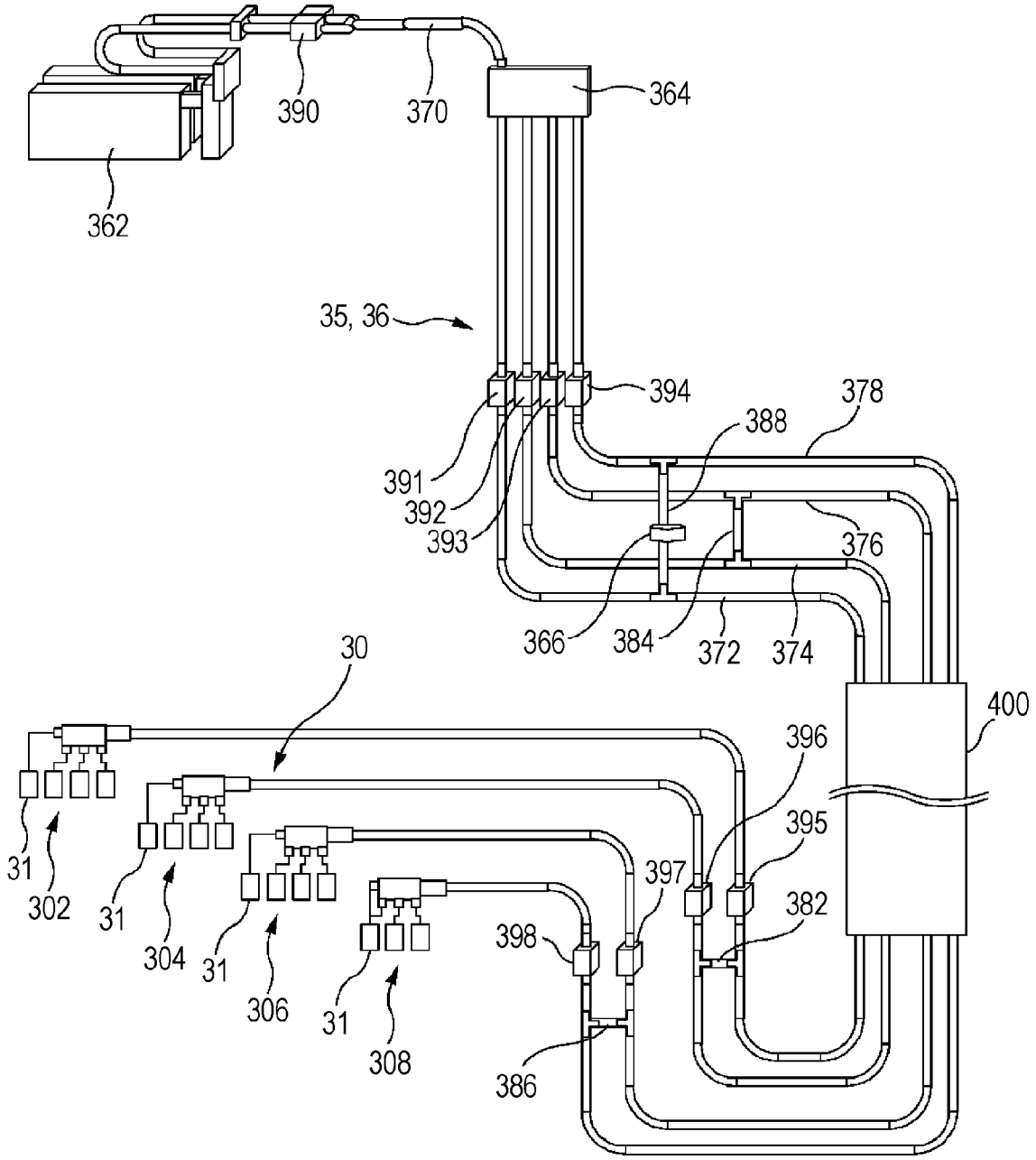
FIG. 3 is a schematic diagram of a white ink supply unit.
Figure 4:
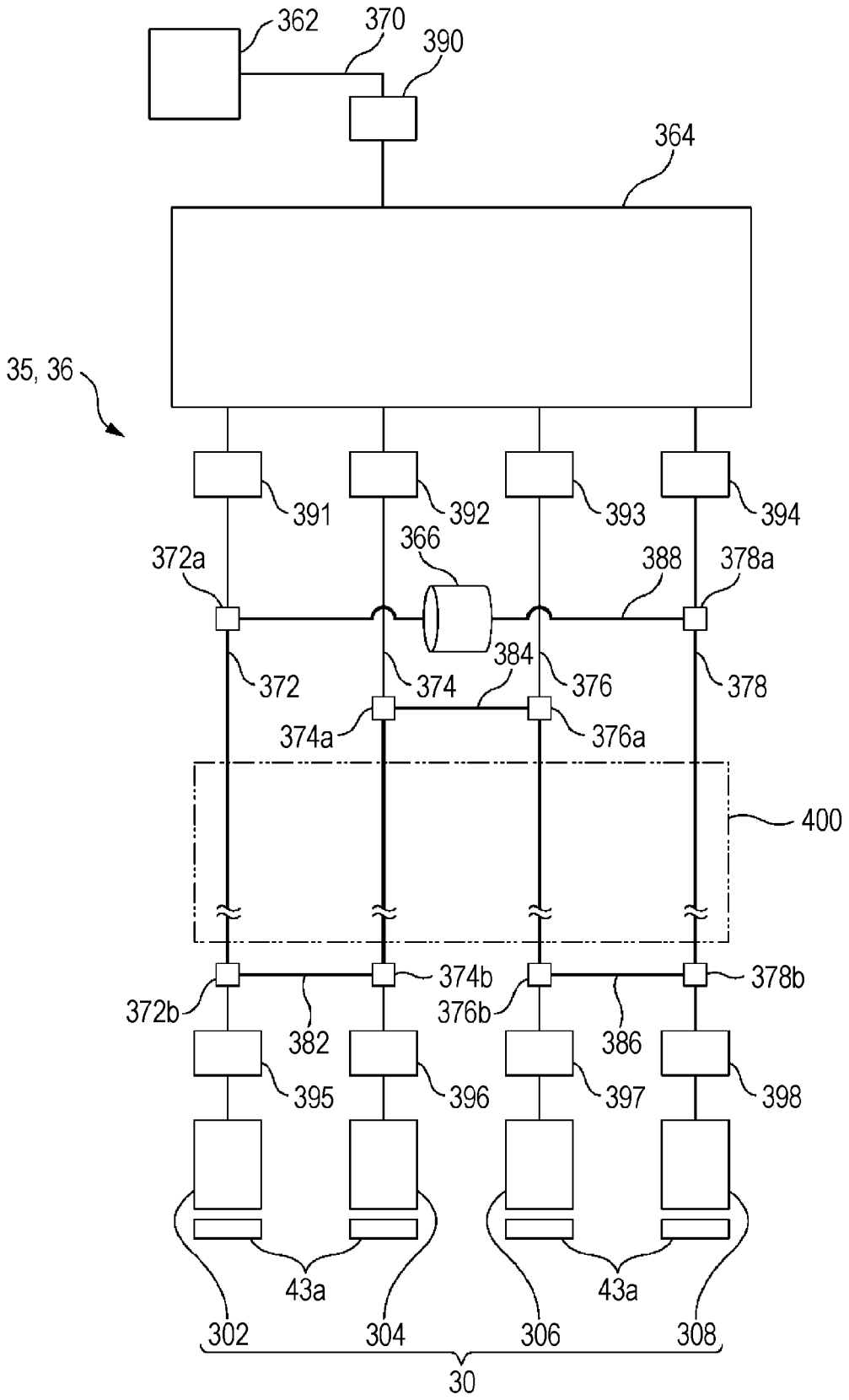
FIG. 4 is a block diagram of the white ink supply unit.

Next, the ink supply unit 35 will be described with reference to FIGS. 1, 3 and 4. FIG. 3 is a schematic diagram of a white ink supply unit 36. FIG. 4 is a block diagram of the white ink supply unit 36. Moreover, FIG. 4 is a diagram of FIG. 3 converted to a block view in order to improve clarity, and FIGS. 3 and 4 are the same (the description will be given using FIG. 4 which is clearer).

As described above, the ink supply unit 35 serves to supply (replenish), when the ink amount in the head unit 30 is decreased due to the discharge of the ink by the heads 31, ink to the head unit 30.

The ink supply unit 35 is provided for each ink kind (ink color). That is, there are provided a yellow ink supply unit to supply a yellow ink, a magenta ink supply unit to supply magenta ink, a cyan ink supply unit to supply cyan ink, a black ink supply unit to supply black ink, a white ink supply unit 36 to supply white ink, etc.

Here, the white ink supply unit 36 has a configuration different from those of other kinds (colors) of ink supply units besides the white ink supply unit (meanwhile, the other kinds (colors) of ink supply units besides the white ink supply unit have the same configuration), though the reason thereof will be described later. Hereinafter, the white ink supply unit 36 will be mainly described among the plurality of ink supply units 35, and the other kinds (colors) of ink supply units will be described only with respect to differences in configuration of the white ink supply unit 36.

As shown in FIG. 4, the white ink supply unit 36 includes an ink cartridge 362, a sub-tank 364 as an example of a storage unit to store ink, a plurality of tubes which becomes an ink passage (path), a plurality of valves to open and close the associated tubes (in the embodiment, each of the valves is a solenoid valve but is not limited thereto), and a pump 366 (in the embodiment, the pump is a tube pump but is not limited thereto). In addition, a place where the ink cartridge 362 and the sub-tank 364 are installed is indicated by reference numerals 35 and 36 in FIG. 1.

The ink cartridge 362 accommodates the ink to be supplied to the head unit 30. This ink cartridge 362 is constituted to be attachable to and detachable from the main body of the image recording apparatus.

In addition, the ink cartridge 362, as shown in FIG. 4, is connected to the sub-tank 364 through a tube which joins the ink cartridge 362 to the sub-tank 364 (for convenience sake, the tube is referred to as a tube between IC-ST 370).

The sub-tank 364 serves to temporally store the ink which is supplied from the ink cartridge 362 to the head unit 30. This sub-tank 364 is fixed to the main body of the image recording apparatus. That is, unlike the ink cartridge 362, the sub-tank 364 has a configuration which is not attachable to and detachable from the main body of the image recording apparatus.

In addition, although it has been previously described that the sub-tank 364 is connected to the ink cartridge 362 through the tube between IC-ST 370, the tube between IC-ST 370 is provided with a valve (for convenience sake, the valve is referred to as a valve between IC-ST 390), as shown in FIG. 4. Furthermore, the sub-tank 364 is provided with a sub-tank sensor (not shown) to detect whether or not the ink amount in the sub-tank 364 becomes less than a threshold.

When the controller 60 ascertains that the ink amount in the sub-tank 364 is less than the threshold by reception of a detection signal from the sub-tank sensor, the controller 60 opens the closed valve between IC-ST 390 and introduces the ink from the ink cartridge 362 to the sub-tank 364. As such, the ink amount is controlled so that an amount of the ink which is equal to or more than the threshold is always present (is stored) in the sub-tank 364.

In addition, the sub-tank 364 is connected to the head unit 30 through four supply tubes which join the sub-tank 364 to the head unit 30, as shown in FIG. 4. These four supply tubes (a first supply tube 372, a second supply tube 374, a third supply tube 376, and a fourth supply tube 378) serve as a supply flow path to supply the ink from the sub-tank 364 to head unit 30.

That is, when the ink is discharged from the head unit 30 (heads 31) by performing the image recording (printing) and the like and the ink in the head unit 30 (heads 31) is consumed, the ink in the sub-tank 364 is introduced through the first supply tube 372 to the fourth supply tube 378 into the head unit 30 (heads 31) so that the consumed ink is replenished.

In addition, as described previously, although the head unit 30 according to the embodiment includes the fifteen heads 31 and the fifteen heads 31 are constituted of the four head groups, namely, the first head group 302 to the fourth head group 308, the four supply tubes are respectively connected to the four head groups as shown in FIG. 4. In other words, each of the four supply tubes supplies the ink to the head group corresponding to the associated supply tube.

That is, the first supply tube 372 is connected to the first head group 302 (first to fourth heads), and supplies the ink to the first to fourth heads. The second supply tube 374 is connected to the second head group 304 (fifth to eighth heads), and supplies the ink to the fifth to eighth heads. The third supply tube 376 is connected to the third head group 306 (ninth to twelfth heads), and supplies the ink to the ninth to twelfth heads. The fourth supply tube 378 is connected to the fourth head group 308 (thirteenth to fifteenth heads), and supplies the ink to the thirteenth to fifteenth heads.

Moreover, as is apparent from FIG. 1, the sub-tank 364 of the ink supply unit 35 is disposed to be spaced distantly from the head unit 30. For this reason, each of the first to fourth supply tubes 372 to 378 is a significantly long tube and has a length of 5 to 6 meters. As shown in FIG. 4, a cableveyor 400 is provided in order to run the first to fourth supply tubes 372 to 378, and the first to fourth supply tubes 372 to 378 accommodate within the cableveyor 400.

In addition, bypass tubes are laid between the supply tubes which are different from one another as shown in FIG. 4. In more detail, four bypass tubes (first bypass tube 382 to fourth bypass tube 388) are provided. The first bypass tube 382 is laid between the first supply tube 372 and the second supply tube 374, the second bypass tube 384 is laid between the second supply tube 374 and the third supply tube 376, the third bypass tube 386 is laid between the third supply tube 376 and the fourth supply tube 378, and the fourth bypass tube 388 is laid between the fourth supply tube 378 and the first supply tube 372.

Moreover, unlike the first to fourth supply tubes 372 to 378, each of the first to fourth bypass tubes 382 to 388 is a significantly short tube and has a length of 5 to 20 cm.

In addition, as shown in FIG. 4, the second and fourth bypass tubes 384 and 388 are disposed together at a position closer to the sub-tank 364 of the sub-tank 364 and the head unit 30, whereas the first and third bypass tubes 382 and 386 are disposed together at a position closer to the head unit 30 of the sub-tank 364 and the head unit 30. In other words, the second and fourth bypass tubes 384 and 388 are disposed outside the cableveyor 400 while being provided between the cableveyor 400 and the sub-tank 364, whereas the first and third bypass tubes 382 and 386 are disposed outside the cableveyor 400 while being provided between the cableveyor 400 and the head unit 30.

These bypass tubes are provided to circulate the ink within a circulation flow path constituted of the supply tubes and the bypass tubes, in order to improve an issue in which the ink stays within the supply tubes and a component of the ink is settled.

That is, the bypass tubes are provided, such that a closed passage is formed by the first supply tube 372, the first bypass tube 382, the second supply tube 374, the second bypass tube 384, the third supply tube 376, the third bypass tube 386, the fourth supply tube 378, and the fourth bypass tube 388 (the closed passage is indicated by a thick line in FIG. 4. Also, the thick line is made thick for convenience sake in order to indicate which part of FIG. 4 is the closed passage, and the thickness of the line is irrelevant to the thickness of the tube.). That is, the formed closed passage is constituted only by the supply tubes and the bypass tubes among the sub-tank 364, the head unit 30, the supply tubes, and the bypass tubes.

The tube (the embodiment exhibits only the fourth bypass tube 388 but is not limited thereto) is provided with a pump 366 in order for the ink to flow in the closed passage. When the pump 366 is operated, the close passage is changed to the circulation flow path and the ink is circulated within the circulation flow path (the above-mentioned issue due to settlement is improved by such an ink circulation).

Moreover, as shown in FIG. 4, each of the four supply tubes is provided with two valves (sub-tank side valve and head unit side valve), and the supply tubes are provided with eight valves in total.

That is, as the sub-tank side valves, the first supply tube 372 is provided with a first sub-tank side valve 391 which is located between a first connection portion 372*a* connected with the fourth bypass tube 388 and the sub-tank 364, the second supply tube 374 is provided with a second sub-tank side valve 392 which is located between a second connection portion 374*a* connected with the second bypass tube 384 and the sub-tank 364, the third supply tube 376 is provided with a third sub-tank side valve 393 which is located between a third connection portion 376*a* connected with the second bypass tube 384 and the sub-tank 364, and the fourth supply tube 378 is provided with a fourth sub-tank side valve 394 which is located between a fourth connection portion 378*a* connected with the fourth bypass tube 388 and the sub-tank 364.

In addition, as the head unit side valves, the first supply tube 372 is provided with a first head unit side valve 395 which is located between a fifth connection portion 372*b* connected with the first bypass tube 382 and the head unit 30, the second supply tube 374 is provided with a second head unit side valve 396 which is located between a sixth connection portion 374*b* connected with the first bypass tube 382 and the head unit 30, the third supply tube 376 is provided with a third head unit side valve 397 which is located between a seventh connection portion 376*b* connected with the third bypass tube 386 and the head unit 30, and the fourth supply tube 378 is provided with a fourth head unit side valve 398 which is located between a eighth connection portion 378*b* connected with the third bypass tube 386 and the head unit 30.

Also, the reason that these sub-tank side valves and head unit side valves are provided will be described later.

Ink Circulation Process to Circulate Ink

Figure 5:
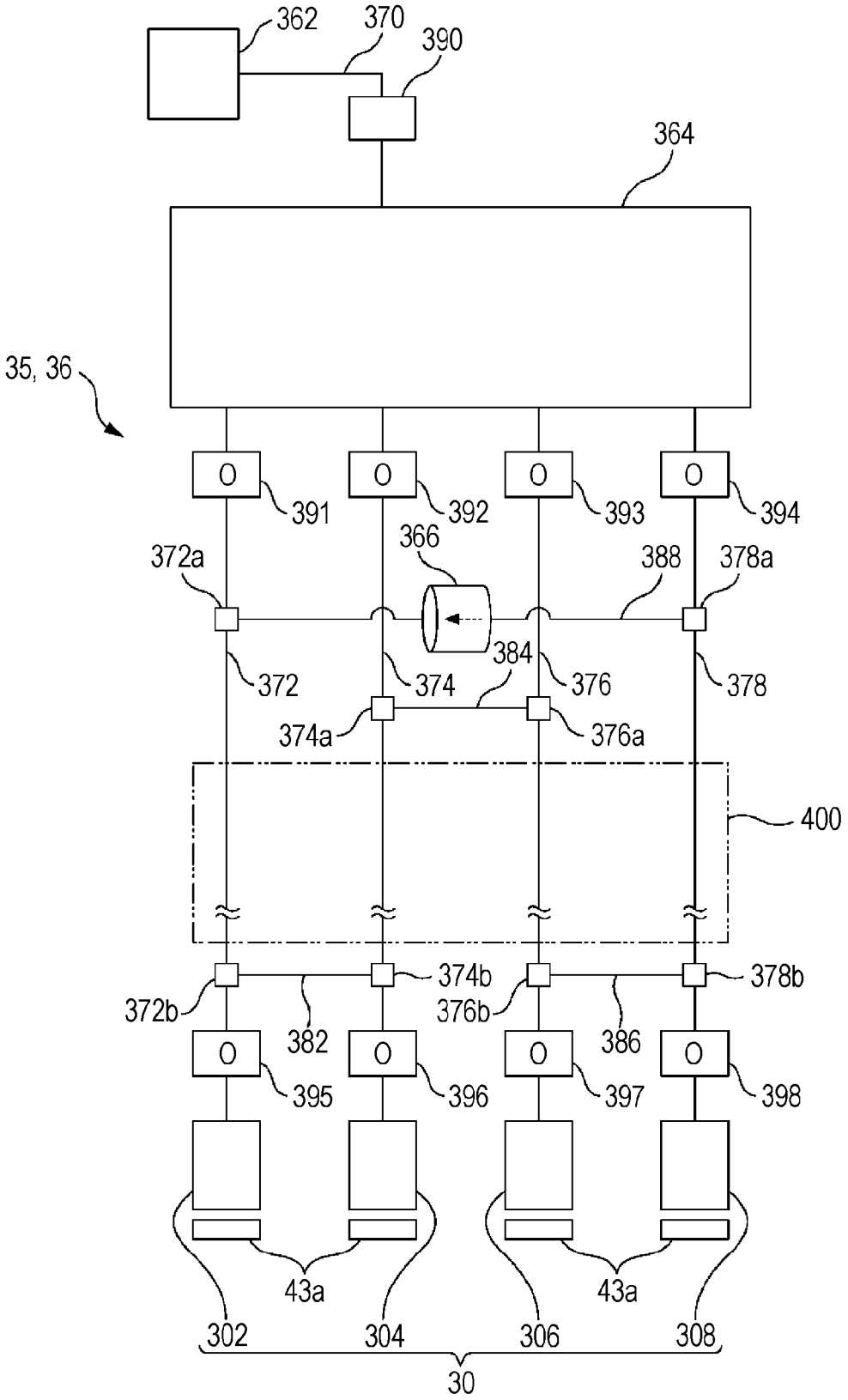
FIG. 5 is a block diagram illustrating a form of the white ink supply unit before an ink circulation process is executed.
Figure 6:
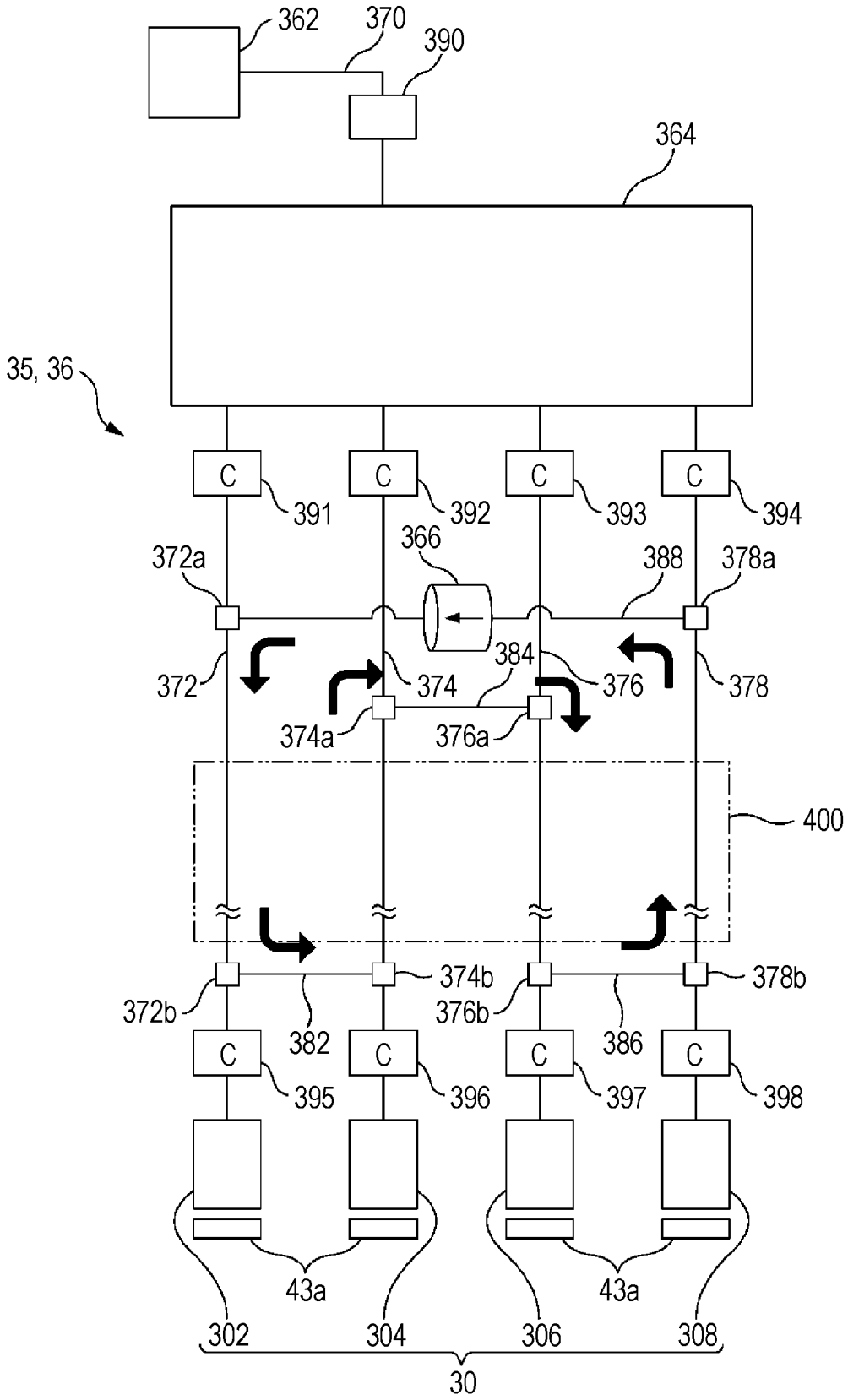
FIG. 6 is a block diagram illustrating a form of the white ink supply unit when the ink circulation process is executed.

Next, a process to circulate the ink in the circulation flow path (for convenience sake, referred to as an ink circulation process) will be described with reference to FIGS. 5 and 6. FIG. 5 is a block diagram illustrating a form of the white ink supply unit 36 before the ink circulation process is executed. FIG. 6 is a block diagram illustrating a form of the white ink supply unit 36 when the ink circulation process is executed.

As described above, when the ink stays within the supply tubes (namely, first to fourth supply tubes 372 to 378), a phenomenon (issue) in which a component of the ink is settled may be caused. Accordingly, if such a phenomenon is generated, ink in which the component is insufficient is discharged onto the roll paper 2, thereby resulting in deterioration in the quality of the image.

Such a phenomenon tends to be caused in a case in which the image recording apparatus 1 is not used for a long time. For this reason, in the embodiment, when power is turned ON, the ink circulation process is set to be executed.

FIG. 5 illustrates a form of the white ink supply unit 36 before the ink circulation process is executed, in other words, a form of the white ink supply unit 36 immediately after the power is turned ON. In this case, as shown in FIG. 5, the sub-tank side valves and the head unit side valves are opened ("○" represents "valve opening"), and the pump 366 is not operated (the dotted line arrow represents "pump non-operation"). Since the image recording apparatus 1 is not used when the power is turned OFF, the ink stays within the first to fourth supply tubes 372 to 378 and a component of the ink is settled.

In such a state, the ink circulation process is performed by the controller 60. That is, the controller 60 causes to circulate the ink within the circulation flow path constituted by the supply tubes and the bypass tubes. In the embodiment, the controller 60 causes to execute the following processes in order to realize the above-mentioned process.

That is, the controller 60 operates the pump 366 as shown in FIG. 6 (the solid line arrow represents "pump operation"). Consequently, the ink is circulated within the circulation flow path and the issue in which a component of the ink is settled is improved. As a result, deterioration in the quality of the image may be suppressed.

Moreover, when the ink is circulated within the circulation flow path, the controller 60 closes the first sub-tank side valve 391 to the fourth sub-tank side valve 394 as shown in FIG. 6, in order for the circulation to be smoothly executed and also in order to completely remove a possibility that the sub-tank 364 is detrimentally affected by movement of the ink due to the circulation ("C" represents "valve closing").

Similarly, the controller 60 closes the first head unit side valve 395 to the fourth head unit side valve 398 as shown in FIG. 6, in order for the circulation to be smoothly executed and also in order to completely remove a possibility that the head unit 30 is detrimentally affected by movement of the ink due to the circulation.

Although it has been previously described that the ink circulation process is performed with a view to improving the phenomenon (issue) in which a component of the ink is settled, such a phenomenon (issue) tends to be caused in the white ink, compared to the other ink. That is, since the pigment component of the white ink contains a heavy substance such as titanium oxide, the pigment component tends to be prominently settled.

For this reason, in the embodiment, the ink circulation process is performed with respect to the white ink only. Accordingly, the bypass tubes, the pump 366, and the head unit side valves are provided at only the white ink supply unit 36, whereas being not provided at other kinds (colors) of ink supply units 35 (meanwhile, the sub-tank side valves are also provided at the other colors of ink supply units 35 since they are necessary for other uses).

However, the embodiment is not limited to the above-mentioned configuration. The bypass tubes, the pump 366, and the head unit side valves may also be provided at the other colors of ink supply units 35, in order to perform the ink circulation process with respect to the other colors of ink.

As described above, the image recording apparatus 1 according to the embodiment includes the sub-tank 364 to store the ink, the head unit 30 to discharge the ink onto the roll paper 2, the plurality of supply tubes to supply the ink from the sub-tank 364 to the head unit 30, the plurality of bypass tubes laid between the supply tubes which are different from one another, and the controller 60 which causes to circulate the ink within the circulation flow path constituted only by the supply tubes and the bypass tubes among the sub-tank 364, the head unit 30, the supply tubes, and the bypass tubes. Consequently, the ink in the supply tubes may be made to flow using a simple configuration.

That is, as described above, there is caused the phenomenon (issue) in which the ink stays within the supply tubes and a component of the ink is settled. Accordingly, if such a phenomenon is generated, ink in which the component is insufficient is discharged onto the roll paper 2, thereby resulting in deterioration in the quality of the image.

Figure 7:
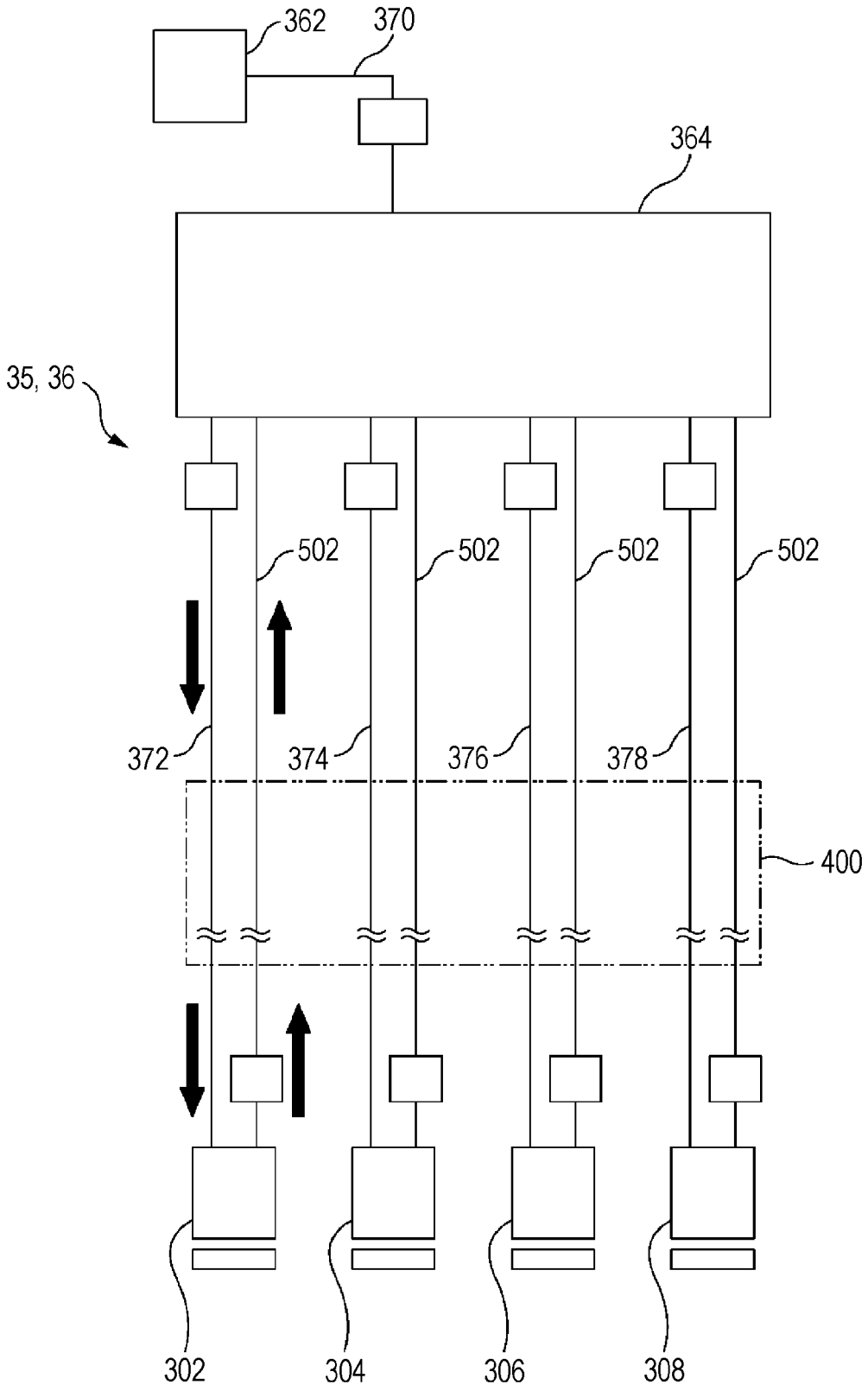
FIG. 7 is a block diagram of a white ink supply unit according to a comparative example.

In order to improve such a phenomenon (issue), an image recording apparatus 1 according to a comparative example adopts a solution in which ink flows by circulating the ink within a circulation flow path, similarly to the embodiment. However, in order for the image recording apparatus 1 according to the comparative example to form the circulation flow path as shown in FIG. 7, return tubes 502 are provided to return the ink to a sub-tank 364 from a head unit 30, and the ink is circulated within the circulation flow path (see the arrows in FIG. 7) which is constituted of the sub-tank 364, the associated one of supply tubes (for example, first supply tube 372), the head unit 30, and the associated one of the return tubes 502.

In such a case, the following issue is caused. That is, the return tubes 502 need to be connected with the sub-tank 364 and the head unit 30, and this connection cannot be considered to be a simple task. In addition, in a case where there are a plurality of supply tubes (for example, four), (for example, four) return tubes which correspond to the respective supply tubes are prepared and each of the return tubes are connected to the sub-tank 364 and the head unit 30 one at a time (see FIG. 7). Therefore, the white ink supply unit 36 according to the comparative example does not have a simple configuration.

With regard to this, the embodiment has been made in view of the above problems, focusing on the presence of a plurality of supply tubes to attain a simple configuration, thereby forming the circulation flow path joining the supply tubes by the bypass tubes. That is, in the embodiment, the ink is circulated within the circulation flow path constituted only by the supply tubes and the bypass tubes among the sub-tank 364, the head unit 30, the supply tubes, and the bypass tubes. Consequently, the circulation flow path may be formed without using the return tubes 502 which need to be connected with the sub-tank 364 and the head unit 30, thereby achieving a simple configuration. That is, in accordance with the embodiment, the ink in the supply tubes may be made to flow using the simple configuration.

Execution Timing of Ink Circulation Process

In the above description, the phenomenon in which the ink stays within the supply tubes and a component of the ink is settled tends to be caused in a case in which the image recording apparatus 1 is not used for a long time. Accordingly, it is effective to execute the ink circulation process when the power is turned ON. However, an execution timing at which the execution of the ink circulation process is effective is not limited to the above case (other execution timing also exists).

Although the ink circulation process is performed even at the other execution timing in the embodiment, herein, what manner of execution timing the other execution timing is will be described with reference to FIG. 8. Next, the following description will be given with respect to effectiveness when the ink circulation process is performed at the other execution timing.

Figure 8:
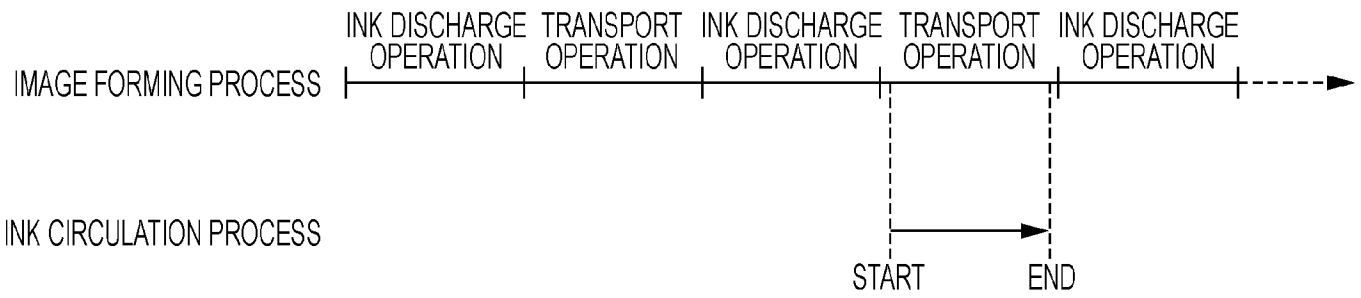
FIG. 8 is a diagram for explaining an execution timing of the ink circulation process.

FIG. 8 is a diagram for explaining the other execution timing.

First, the upper drawing in FIG. 8 will be focused on. The upper drawing illustrates an image forming process in a time series manner (the arrow represents a time axis). That is, as shown in the drawing, the controller 60 causes alternately to repeat a transport operation which controls the above-mentioned transport unit 20 and transports the roll paper 2, and an ink discharge operation which discharges the ink from the head unit 30 (in the embodiment, an ink discharge operation which discharges the ink from the head unit 30 and impacts the ink on the part of the roll paper 2 located at the image recording region R in a state where the roll paper 2 is stopped (in a state where the transport is stopped as described above)), thereby to execute the image forming process to form the image on the roll paper 2.

As shown in a lower drawing of FIG. 8, the controller 60 causes to execute the ink circulation process when the ink is not discharged during the execution of the image forming process. In detail, in the embodiment, when the transport operation is performed, the ink circulation process is performed.

As such, in the embodiment, unlike the above-mentioned execution timing (when the power is turned ON), the ink circulation process is executed when the image recording apparatus 1 is used, namely, during the execution of the image forming process.

In addition, although the ink circulation process is exhibited as being performed in one transport operation of the repeated transport operations (the plurality of transport operations) as shown in FIG. 8 in the above description, this is only an example and the embodiment is not limited to this example. For example, the ink circulation process may also be performed every time in the repeated transport operations (the plurality of transport operations).

Effectiveness of Image Recording Apparatus 1 According to the Embodiment

As described above, the image recording apparatus 1 according to the embodiment includes the transport unit 20 to transport the roll paper 2, the sub-tank 364 to store the ink, the head unit 30 to discharge the ink onto the roll paper 2, the plurality of supply tubes to supply the ink from the sub-tank 364 to the head unit 30, the plurality of bypass tubes laid between the supply tubes which are different from one another, and the controller 60. The controller 60 causes alternately to repeat the transport operation which controls the transport unit 20 and transports the roll paper 2, and the ink discharge operation which discharges the ink from the head unit 30, thereby to execute the image forming process to form the image on the roll paper 2, and to circulate, when the ink is not discharged during the execution of the image forming process, the ink within the circulation flow path constituted only by the supply tubes and the bypass tubes among the sub-tank 364, the head unit 30, the supply tubes, and the bypass tubes. Consequently, deterioration in the quality of the image may be appropriately suppressed.

That is, as described above, there is caused the phenomenon (issue) in which the ink stays within the supply tubes and a component of the ink is settled. Accordingly, if such a phenomenon is generated, ink in which the component is insufficient is discharged onto the roll paper 2, thereby resulting in deterioration in the quality of the image.

Such a phenomenon is caused in a case in which the image recording apparatus 1 is not used for a long time. Therefore, in the image recording apparatus 1 according to the comparative example, the ink circulation process is performed at a timing when the power is turned ON.

However, in the image recording apparatus 1 according to the comparative example, the ink circulation process is not performed during the execution of the image forming process for which the image recording apparatus 1 is used. The present inventors have found that the following problem is generated if the ink circulation process is not performed at such a timing.

That is, there is a case where an ink discharge operation exists in which a part of the plurality of head groups does not discharge the ink during the ink discharge operation executed in the image forming process. That is, for example, although the first to fourth head groups 302 to 308 as the above-mentioned head groups are provided, there may be a case where the ink is never discharged from the fourth head group 308 in spite of performing the ink discharge operation (printing). As a specific example of such a case, there may be exemplified a case in which an image (image to be formed by discharge of the ink from the fourth head group 308), corresponding to the fourth head group 308, itself does not exist. In addition, since the roll paper 2 having a narrow width is used, there is also a case in which the roll paper 2 is not at a position (position to be formed with the image by discharge of the ink from the fourth head group 308) corresponding to the fourth head group 308.

In this case, in the ink discharge operation, the ink is consumed from the first to third head groups 302 to 306 whereas being not consumed from the fourth head group 308. Accordingly, while the ink flows in the first to third supply tubes 372 to 376, the fourth supply tube 378 causes the phenomenon in which the ink stays and a component of the ink is settled.

Furthermore, when the execution of the ink discharge operation is repeated in which such a partial head group (for example, fourth head group 308) does not discharge the ink in the image forming process, the phenomenon is further caused in which a component of the ink is settled in the fourth supply tube 378.

In contrast, in a case in which the ink is not discharged during the execution of the image forming process (that is, when the transport operation is performed), since the ink circulation process is executed, the ink appropriately flows in the fourth supply tube 378 by circulating the ink within the circulation flow path, in the embodiment as shown in FIG. 8. For this reason, there is not caused the problem that the ink stays and a component of the ink is settled in the fourth supply tube 378. Consequently, deterioration in the quality of the image may be appropriately suppressed.

In addition, in the embodiment, the platen 29 is provided which supports and heats the roll paper 2, and the head unit 30 discharges the ink onto the roll paper 2 which is supported and heated by the platen 29. For this reason, the head unit 30 is located adjacent to the platen 29. Accordingly, the ink in the supply tubes connected to the head unit 30 is affected by heat from the platen 29.

In such a situation, the following problem (hereinafter, referred to as a viscosity difference problem for convenience sake and see below) may be caused in addition to the above-mentioned problem (hereinafter, referred to as a settlement problem for convenience sake) that the ink stays and a component of the ink is settled in the fourth supply tube 378. That is, since the ink stays in the fourth supply tube 378, the ink has a temperature higher than that of the ink which flows in the first to third supply tubes 372 to 376. Consequently, a viscosity difference is generated between the ink in the fourth supply tube 378 and the ink in the first to third supply tubes 372 to 376 (in the embodiment, the viscosity of the ink in the fourth supply tube 378 becomes more smaller). For this reason, the viscosity difference is generated between the ink discharged from the first to third head groups 302 to 306 and the ink discharged from the fourth head group 308, with the consequence that a difference in image quality is exhibited between the image by the ink discharged from the first to third head groups 302 to 306 and the image by the ink discharged from the fourth head group 308.

Accordingly, in a case of including a so-called heating platen (in a case of the image recording apparatus 1 according to the embodiment), the controller 60 may solve the viscosity difference problem in addition to the settlement problem by the execution of the ink circulation process when the ink is not discharged during the execution of the image forming process. Therefore, the above-mentioned effect, namely, the effect to appropriately suppress deterioration in the quality of the image may be achieved more effectively.

Other Embodiment

In the above embodiment, the liquid discharge apparatus is mainly described, but a disclosure of a liquid circulation method and the like are also included. In addition, the above embodiment makes the invention understood easily and is not intended for limiting interpretation of the invention. It is needless to say that the invention can be changed and improved without departing from the scope of the invention and the invention includes equivalents thereof. In particular, the following embodiments are included in the invention.

In the above embodiment, the liquid discharge apparatus (liquid ejecting apparatus) is embodied as the ink jet printer. However, liquid ejecting apparatuses which eject and discharge liquid other than ink may be employed. The invention may be applied to various types of liquid ejecting apparatuses including a liquid ejecting head or the like which discharges a small amount of liquid droplets. Note that the terminology "liquid droplets" represents a state of liquid which is discharged from the above liquid ejecting apparatus. For example, a granule form, a teardrop form, and a form that pulls tails in a string-like form therebehind are included as the liquid droplets. In addition, the terminology "liquid" here represents materials which may be ejected by the liquid ejecting apparatus. For example, any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) may be included as the liquid. Further, the liquid is not limited to liquid as one state of a material but includes a solution, a dispersion or a mixture of particles of a functional material made of a solid material such as pigment particles or metal particles in a solvent. Also, typical examples of the liquid are ink described in the above embodiment and liquid crystals. The terminology "ink" here encompasses various liquid compositions such as common aqueous ink and oil ink, gel ink and hot melt ink. Specific examples of the liquid ejecting apparatus include a liquid ejecting apparatus which ejects liquid in a form of a dispersion or a solution of a material such as an electrode material or a coloring material. The material such as the electrode material or the coloring material is used for manufacturing a liquid crystal display, an EL (electroluminescence) display, a surface emitting display and a color filter, for example. Furthermore, the specific examples of the liquid ejecting apparatus include a liquid ejecting apparatus which ejects a bioorganic material used for manufacturing biochips, a liquid ejecting apparatus which ejects liquid used as a precision pipette and serving as a sample, printing equipment and a micro dispenser. Other examples of the liquid ejecting apparatus include a liquid ejecting apparatus which pinpoint-ejects lubricating oil to a precision machine such as a watch or a camera. Furthermore, a liquid ejecting apparatus which ejects a transparent resin solution of an ultraviolet curable resin or the like onto a substrate in order to form a hemispherical micro-lens (optical lens) used for an optical communication element and the like is included as the liquid ejecting apparatus. In addition, a liquid ejecting apparatus which ejects an acid or alkali etching solution for etching a substrate or the like may be employed as the liquid ejecting apparatus. The invention may be applied to anyone type of the liquid ejecting apparatuses.

In the above embodiment, the roll paper 2 has been described as an example of a medium, but the embodiment is not limited thereto. For example, the medium may be cut paper, a film, a fabric, etc.

In the above embodiment, the sub-tank 364 has been described as an example of a storage unit, but the embodiment is not limited thereto. For example, the ink cartridge 362 may be connected to the head unit 30 through the supply tubes without the presence of the sub-tank 364 (in this case, the ink cartridge 362 corresponds to the storage unit).

In the above embodiment, the head groups have been described as an example of sub-head units, but the embodiment is not limited thereto. For example, a single head may also be provided.

Figure 9A:
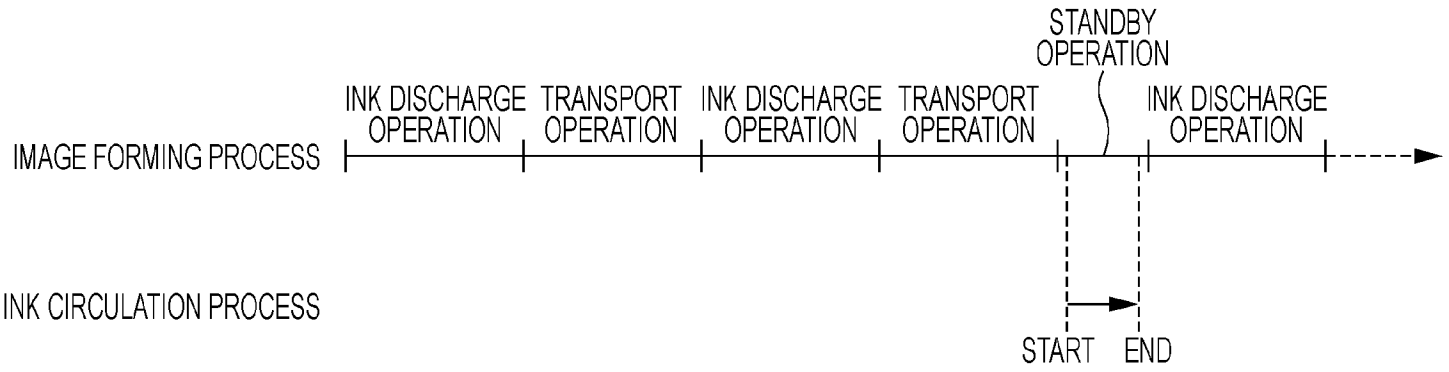
FIGS. 9A and 9B are diagrams for explaining an execution timing of an ink circulation process according to a first modification example.
Figure 9B:
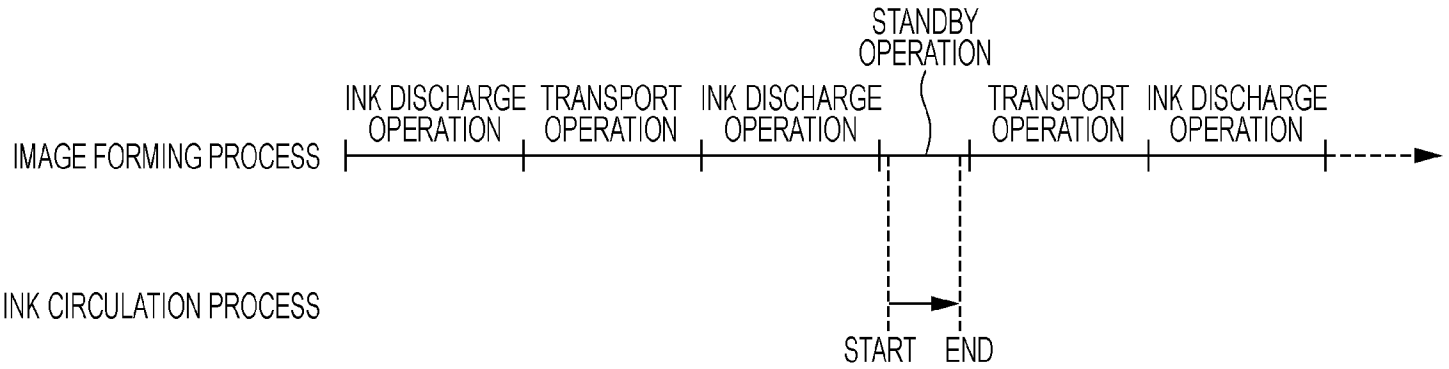

In the above embodiment, the controller 60 causes to circulate the ink within the circulation flow path when the transport operation is performed. That is, in the above embodiment, the timing for performing the transport operation has been described as an example of an execution timing (of the ink circulation process) at which the ink is not discharged during the execution of the image forming process, but the embodiment is not limited thereto. For example, as shown in FIGS. 9A and 9B, a waiting period may be provided between the ink discharge operation and the transport operation in order to execute the ink circulation process and the ink circulation process may also be performed for the waiting period.

However, the above embodiment may be preferable in that an effective process may be realized since the ink is circulated effectively using a time at which the transport operation is performed.

Figure 10A:
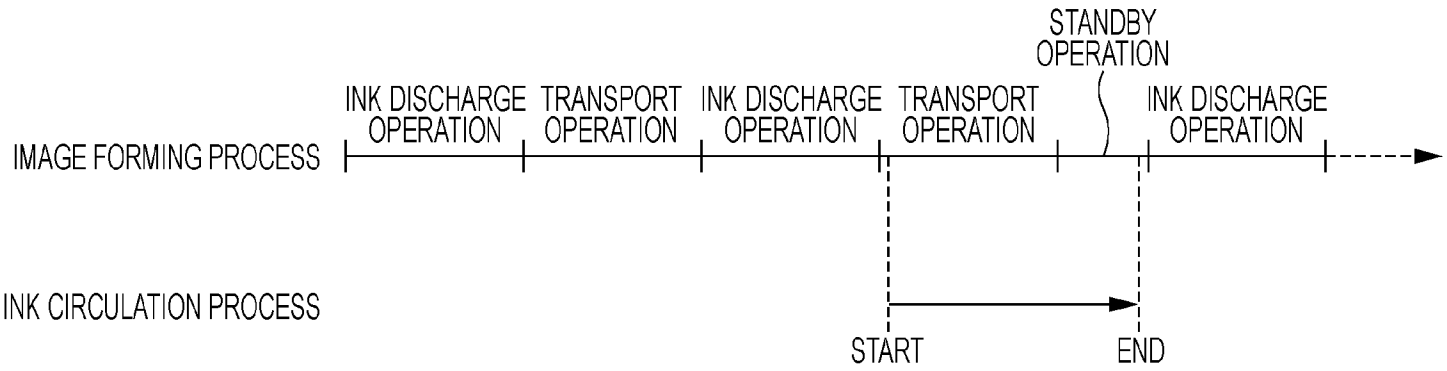
FIGS. 10A and 10B are diagrams for explaining an execution timing of an ink circulation process according to a second modification example.
Figure 10B:
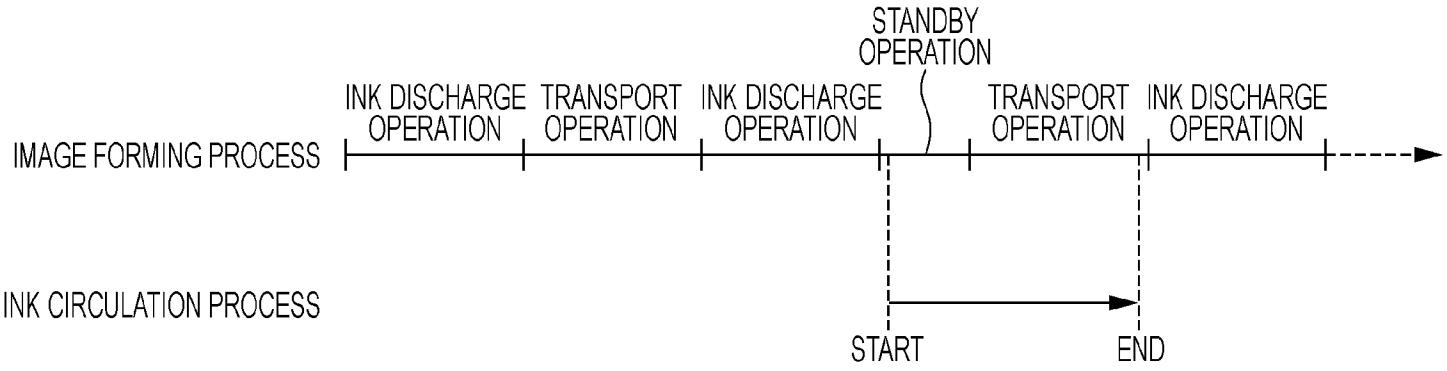

In the above embodiment, the case in which both of the start time and the end time of the ink circulation process are within a transport operation period (in other words, the case in which an ink circulation process period is included in the transport operation period) has been described as an example which circulates the ink within the circulation flow path when the transport operation is performed, but the embodiment is not limited thereto. For example, as shown in FIGS. 10A and 10B, which one of the start time and the end time of the ink circulation process may also be within the transport operation period (that is, the ink circulation process period and the transport operation period may partially overlap each other). The case of FIGS. 10A and 10B has superiority in that the ink circulation process period may be secured even when the ink circulation process for the transport operation period is insufficient.

In addition, the controller 60 determines whether or not the ink discharge operation exists in which a part of the plurality of head groups does not discharge the ink (for example, the ink discharge operation in which the fourth head group 308 of the first to fourth head groups 302 to 308 does not discharge the ink as described above). Then, the controller 60 may also determine whether or not to circulate the ink within the circulation flow path, based on the determined result.

That is, when the controller 60 receives printing data from the host computer 110, the controller 60 determines whether or not the ink discharge operation exists in which the partial head group (for example, the fourth head group 308) does not discharge the ink by analyzing the printing data or the contents of various types of commands included in the printing data (it may be possible to ascertain a case where the image corresponding to the fourth head group 308 does not exist, or a case where the roll paper 2 is not at a position corresponding to the fourth head group 308 by the analysis).

The controller 60 determines whether or not to perform the ink circulation process based on the determined result. That is, in a case where it is determined as "exist", the ink circulation process is executed during the image forming process in order to solve the problem that the ink stays and a component of the ink is settled in the fourth supply tube 378, as shown in FIG. 8. On the other hand, in a case where it is determined as "not exist (no)", the ink circulation process is not executed during the image forming process since the problem that the ink stays and a component of the ink is settled in the fourth supply tube 378 is not caused.

In accordance with the above description, since the ink circulation process is executed only if necessary, an effective process may be realized (in addition, it is effective in terms of power consumption for operating the pump 366, the sub-tank side valves, and the head unit side valves or aged deterioration thereof).

Meanwhile, the case in which the ink circulation process is performed during the image forming process by omitting the above determination may have superiority in that the simple control is achieved.

What is claimed is:

1. A liquid discharge apparatus comprising:

a transporting unit to transport a medium;

a storage unit to store liquid;

a head unit to discharge the liquid onto the medium;

a plurality of supply flow paths to supply the liquid from the storage unit to the head unit;

a plurality of bypass flow paths laid between the supply flow paths which are different from one another; and a controller configured to:

perform a transport operation that causes the transporting unit to transport the medium;

perform a liquid discharge operation that causes the head unit to discharge the liquid onto the medium to thereby form an image on the medium; and when the liquid is not being discharged onto the medium during the discharge operation, circulate the liquid within a closed-loop circulation flow path that is formed by the supply flow paths and the bypass flow paths only, such that when circulating in the closed-loop circulating flow path, the liquid substantially only circulates in the supply flow paths and the bypass flow paths.

2. The liquid discharge apparatus according to claim 1, wherein the controller causes to circulate the liquid within the circulation flow path when the transport operation is performed.

3. The liquid discharge apparatus according to claim 1, wherein the head unit includes a plurality of sub-head units, wherein each of the plurality of supply flow paths supplies the liquid to the sub-head unit corresponding to each supply flow path, and wherein the controller determines whether or not the liquid discharge operation exists in which a part of the plurality of sub-head units does not discharge the liquid, and determines whether or not to circulate the liquid within the circulation flow path based on the determined result.

4. The liquid discharge apparatus according to claim 1, further comprising:

a platen to support and heat the medium, wherein the head unit discharges the liquid onto the medium which is supported and heated by the platen.

5. A liquid circulation method comprising:

alternately repeating:

a transport operation in which a transporting unit is caused to transport a medium;

a liquid discharge operation in which a head unit is caused to discharge the liquid onto the medium to thereby form an image on the medium; and a circulation operation that is performed when the liquid is not being discharged onto the medium during the discharge operation, the circulation operation circulating the liquid within a closed-loop circulation flow path that is formed by a plurality of supply flow paths that supply the liquid from a storage unit to the head unit and a plurality of bypass flow paths laid between the supply flow paths only, such that when circulating in the closed-loop circulating flow path, the liquid substantially only circulates in the supply flow paths and the bypass flow paths.

* * * * *